US007703166B2

(12) United States Patent
Raddick

(10) Patent No.: US 7,703,166 B2
(45) Date of Patent: Apr. 27, 2010

(54) RIDING FLOOR AND EDGE STRIPPER APPLICATOR

(76) Inventor: Mark Raddick, 519 Lock Street West, Unit C, Dunnville, ON (CA) N1A 1V8

( * ) Notice: Subject to any disclaimer, the term of this patent is extended or adjusted under 35 U.S.C. 154(b) by 871 days.

(21) Appl. No.: 11/531,303

(22) Filed: Sep. 13, 2006

(65) Prior Publication Data

US 2007/0068452 A1 Mar. 29, 2007

Related U.S. Application Data

(60) Provisional application No. 60/596,488, filed on Sep. 28, 2005.

(51) Int. Cl.
*B05B 9/06* (2006.01)
*A47L 7/00* (2006.01)

(52) U.S. Cl. ..... 15/98; 15/321; 118/323

(58) Field of Classification Search ..... 15/49.1, 15/98; 118/207, 305; 280/836, 32.7, 240; 404/91, 8, 97, 131
See application file for complete search history.

(56) References Cited

U.S. PATENT DOCUMENTS

| | | | | |
|---|---|---|---|---|
| 2,272,983 | A | | 2/1942 | Payne |
| 2,469,060 | A | | 5/1949 | Vosbikian et al. |
| 2,678,458 | A | | 5/1954 | Vosbikian et al. |
| 2,979,756 | A | | 4/1961 | Wallis |
| 3,457,015 | A | | 7/1969 | Taber |
| 3,981,596 | A | | 9/1976 | Melton |
| 4,010,507 | A | | 3/1977 | Johnson |
| 4,093,260 | A | * | 6/1978 | Terzian et al. ..... 280/240 |
| 4,107,813 | A | * | 8/1978 | Torres ..... 15/246 |
| 4,124,315 | A | | 11/1978 | Melton |
| 4,152,084 | A | | 5/1979 | Melton |
| 5,033,564 | A | | 7/1991 | Mattson |
| 5,063,633 | A | * | 11/1991 | Ingermann et al. ..... 15/320 |
| 5,185,901 | A | * | 2/1993 | Davis et al. ..... 15/98 |
| 6,017,163 | A | | 1/2000 | Keppers et al. |
| 6,023,813 | A | | 2/2000 | Thatcher |
| 6,059,309 | A | | 5/2000 | Munnoch |
| 6,155,907 | A | * | 12/2000 | Jones ..... 451/28 |
| 6,419,565 | B2 | | 7/2002 | Mattson |
| 6,442,789 | B1 | | 9/2002 | Legatt |
| 6,487,746 | B1 | | 12/2002 | Cioci |

FOREIGN PATENT DOCUMENTS

| | | | |
|---|---|---|---|
| EP | 795647 A1 | * | 9/1997 |
| JP | 58145506 A | * | 8/1983 |
| JP | 07001921 A | * | 1/1995 |

* cited by examiner

*Primary Examiner*—Monica S Carter
*Assistant Examiner*—Stephanie Newton

(57) ABSTRACT

A riding floor and edge stripper applicator comprises a frame including attached thereto at least three wheels, a seat and a drive and steering mechanism for driving and steering the wheels. The stripper includes at least one tank mounted on the frame for holding stripping solution in fluid communication with supply conduits for delivering stripping solution to the mops. It further includes a central mop for receiving striping solution from the supply conduits and applying the solution to the floor. The stripper further includes at least one swinging mop for receiving striping solution from the supply conduits and applying the solution to a floor, the swinging mop pivotally attached at one distal end to the central mop and moveable between an extended position and a retracted position.

12 Claims, 6 Drawing Sheets

FIG. 3
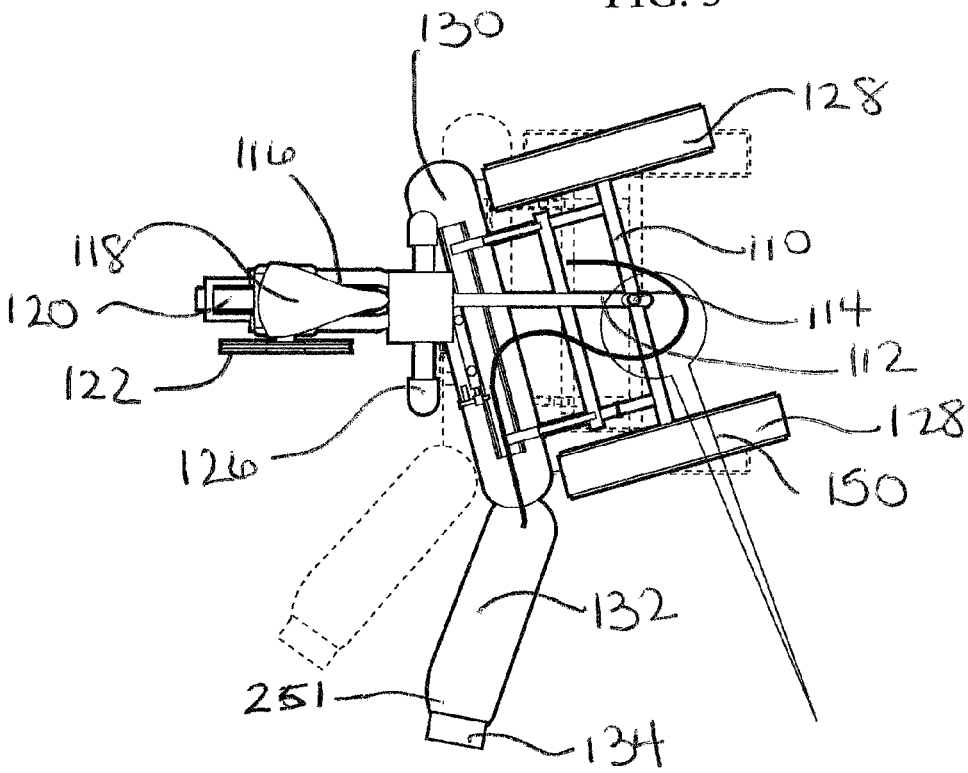
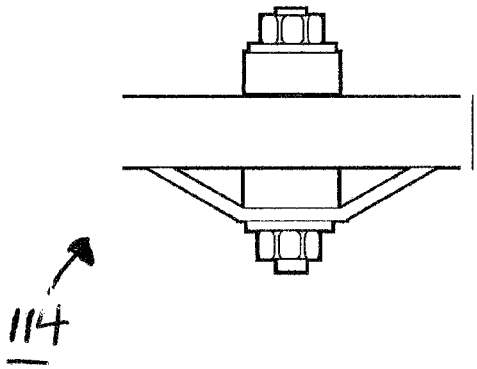
FIG. 4
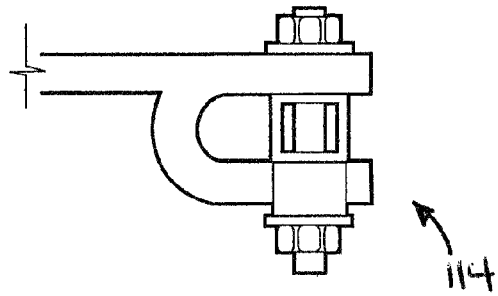
FIG. 5

FIG. 6
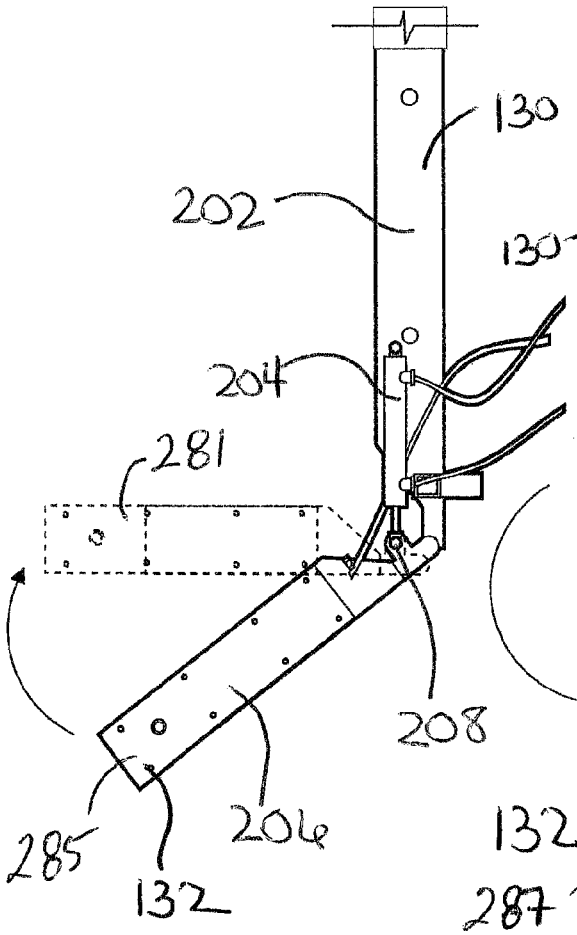
FIG. 7
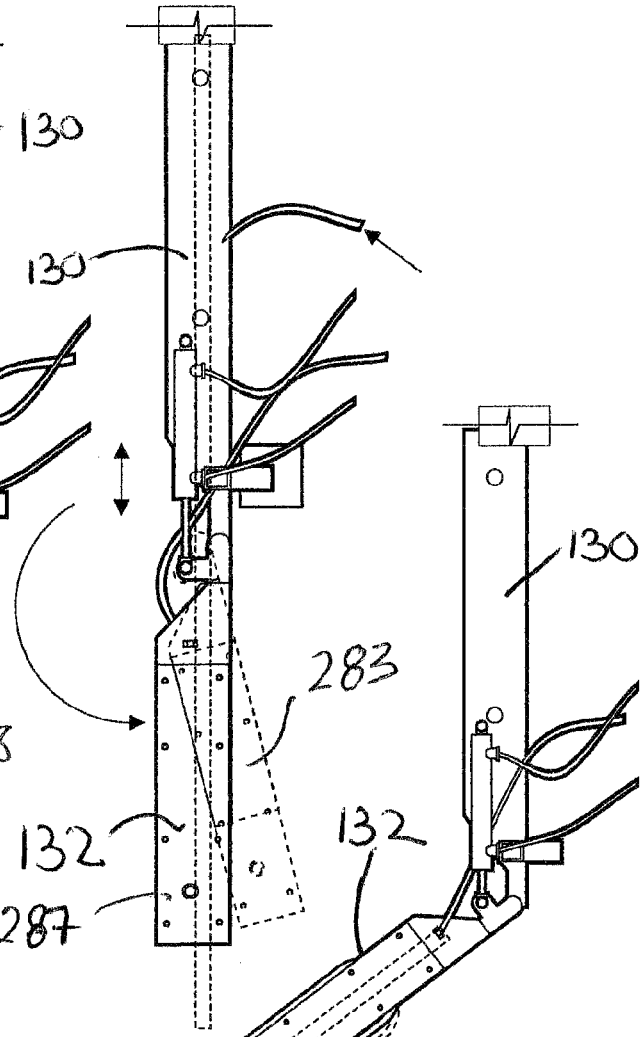
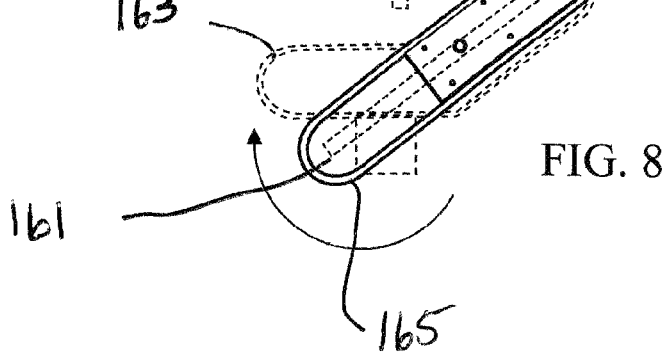
FIG. 8

FIG. 11
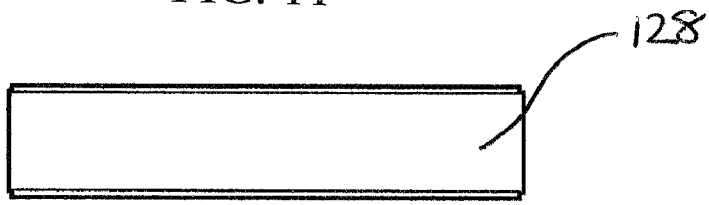
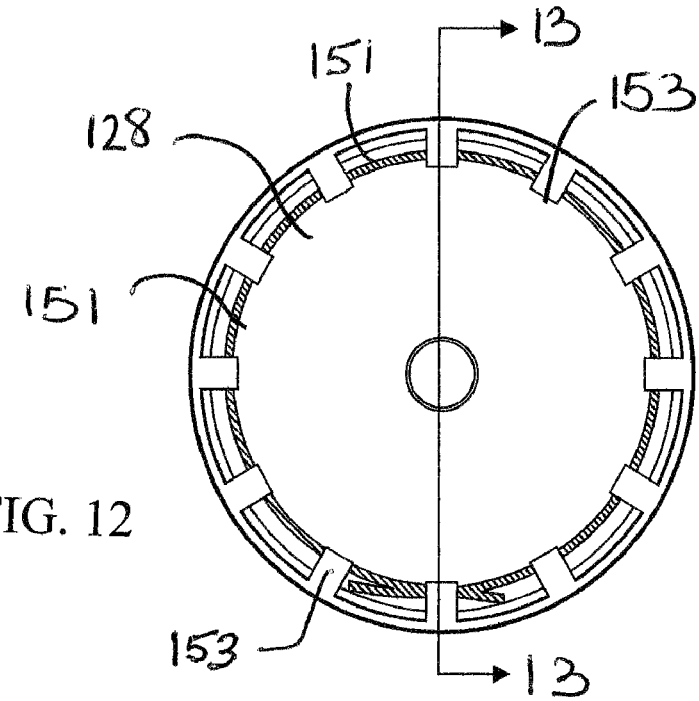
FIG. 12
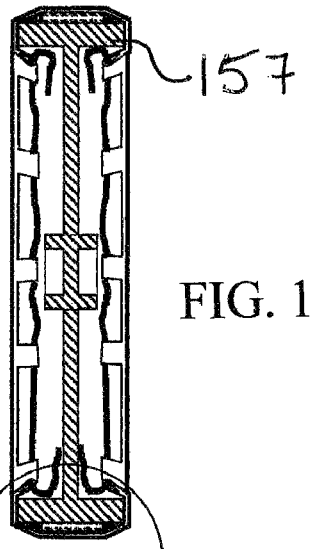
FIG. 13
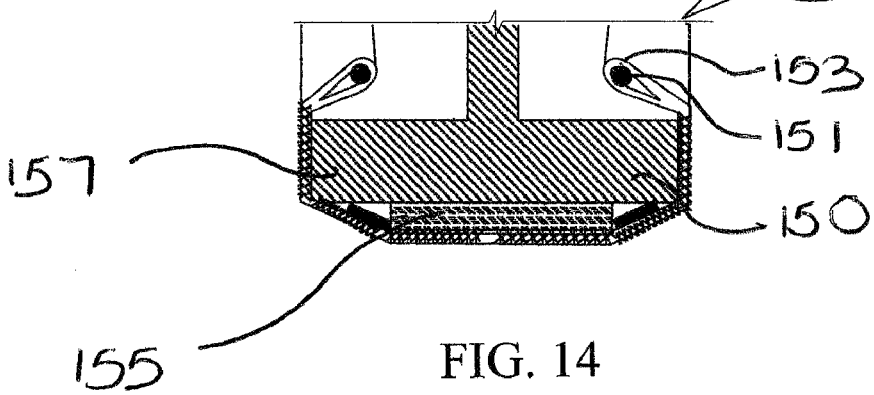
FIG. 14

RIDING FLOOR AND EDGE STRIPPER APPLICATOR

The present application claims the benefit of previously filed U.S. Provisional Application 60/596,488 filed Sep. 28, 2005 under the title RIDING FLOOR AND EDGE STRIPPER APPLICATOR by MARK RADDICK.

FIELD OF INVENTION

The present invention relates to application of stripping solutions to floors and base boards and/or floor edges and more particularly relates to a riding floor and edge stripper applicator.

SUMMARY OF INVENTION

Currently floor stripping solutions are applied using mops and/or walk behind applicators similar to the ones depicted in U.S. Pat. No. 3,457,015 titled: MOBILE WAX APPLICATOR issued on Jul. 27, 1969 to James Taber and/or the device described in U.S. Pat. No. 4,152,084 titled: PORTABLE FLOOR FINISH APPLICATOR issued May 1, 1979 to Joseph E. Melton and Glen G. Lorch and/or the device as described in U.S. Pat. No. 6,017,163 titled: FLOOR FINISH DISTRIBUTION APPARATUS issued Jan. 25, 2000 to Keppers et al and/or variations of these types of equipment.

Powered and/or riding Floor Finishing Machines as described in U.S. Pat. No. 6,023,813 titled: POWERED FLOOR SCRUBBER AND BUFFER issued Feb. 15, 2002 to David Thatcher et al are limited to floors which either scrub, apply and/or polish floor services, however to date there has been no successful power operated stripper applicator brought to the market due to the inherent difficulties with applying stripper to floors.

The difficulty with the application of stripper is that once the chemical solution is applied to the floor, the floors become extremely slick and personnel who are applying the solution manually find it very difficult, if not impossible to walk over the surface. Machines that have attempted to apply stripper to floors, find it difficult and dangerous to move the equipment over the floors once the stripper has been applied, because of the extremely slick surface conditions.

The nature of floor stripping requires that the floor continually be maintained in a moist or wet condition in order for the stripper to actively remove the surface finish. Therefore, it is necessary to continually reapply solution and/or liquid over the portions of the floor and/or edges that have dried, in order to reactivate the solution to the point where the stripper is able to complete the chemical reaction and remove the floor stripper. Therefore, in order for the stripper to completely remove the existing floor finish from the floor end or edge, it is always necessary to make additional passes over the dry areas of the floor to add additional stripper to the floor to complete the stripping process until the finish has been completely emulsified A person skilled in the art will know how slippery the floor surface is once stripper has been applied and those working with stripping solutions find it difficult and dangerous to walk over or take any kind of machine over surfaces where stripper has already been applied.

Therefore, it is desirable to have a machine which the personnel do not need to walk over floor surfaces having stripper applied thereon and has the capability of making multiple passes over the floor surface to be stripped and add additional floor stripper as required as the floor surface dries out. It is also desirable to have a machine which can apply stripper to the floor edges, or baseboard portion.

BRIEF DESCRIPTION OF THE DRAWINGS

The present invention will now be described by way of example only with reference to the following drawing in which:

FIG. 3 is a top plan view of the bottom portion of the present invention a riding floor and edge stripper applicator.

FIG. 4 is a front elevational view of the pivot.

FIG. 5 is a side elevational view of the pivot.

FIG. 6 is a top plan view of the central mop together with the swinging mop, showing the swinging mop portion in various positions.

FIG. 7 is a top plan view of the central mop together with the swinging mop, showing the swinging mop portion in various positions.

FIG. 8 is a top plan view of the central mop together with a swinging mop showing the flexible tip portion of the mop in various positions.

FIG. 11 is a top plan view of the front wheel.

FIG. 12 is a side elevational view of the front wheel.

FIG. 13 is a cross sectional view of the front wheel taken through section 13-13 of the FIG. 12.

FIG. 14 is a partial cross sectional view of front wheel 128.

DETAILED DESCRIPTION OF THE PREFERRED EMBODIMENT

Figures 1, 2:
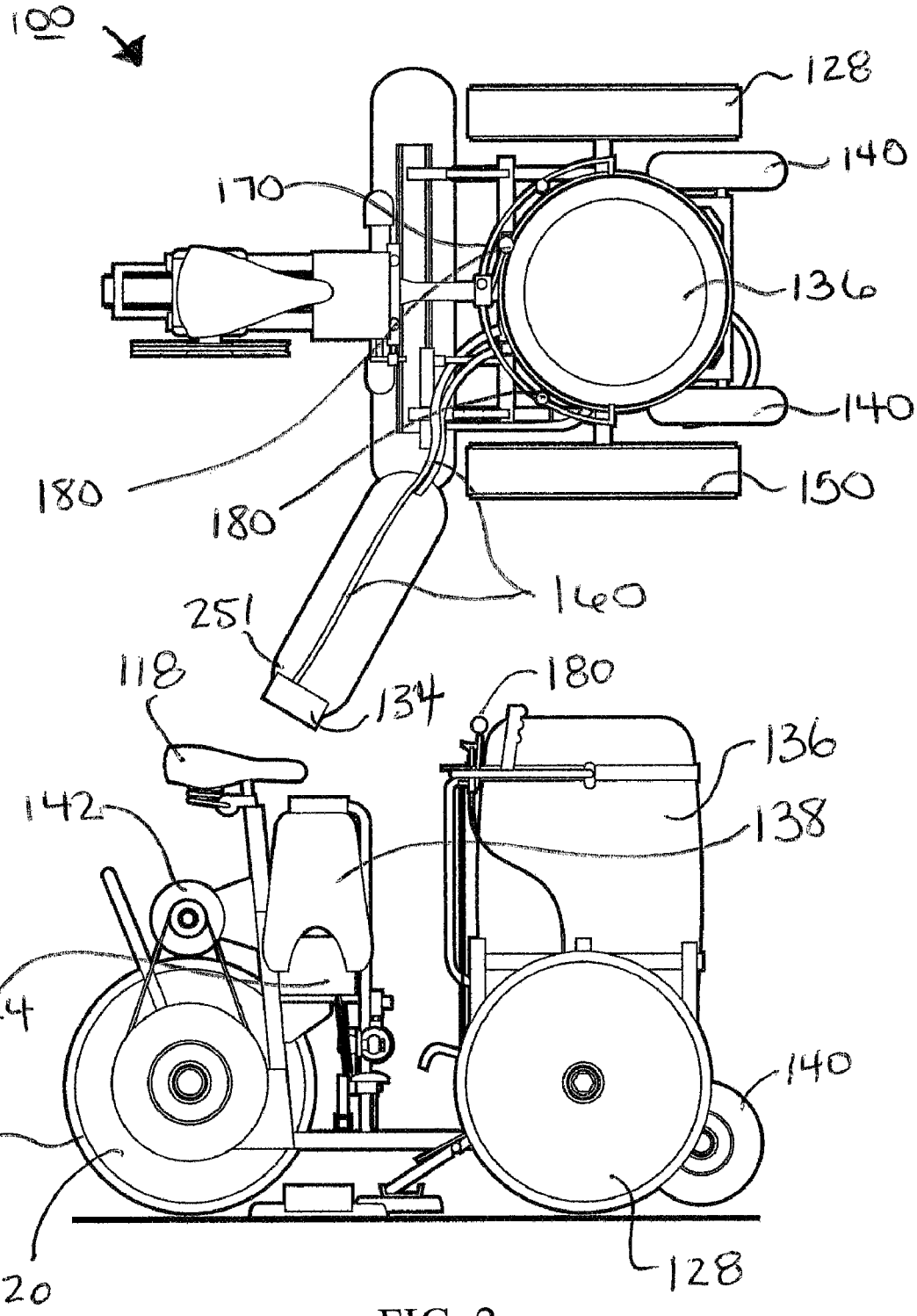
FIG. 1 is a top plan view of the present invention a riding floor and edge stripper applicator.
FIG. 2 is a side elevational view of the present invention a riding floor and edge stripper applicator.
Figure 9:
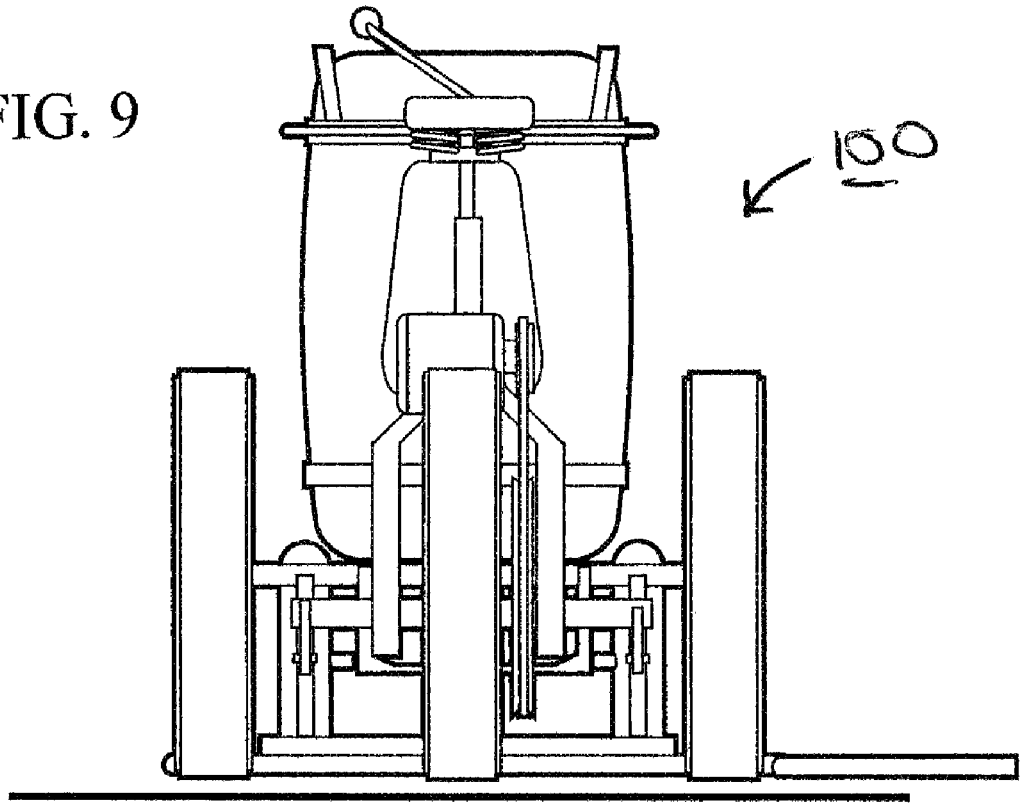
FIG. 9 is a rear elevational view of the present invention a riding floor and edge stripper applicator.
Figure 10:
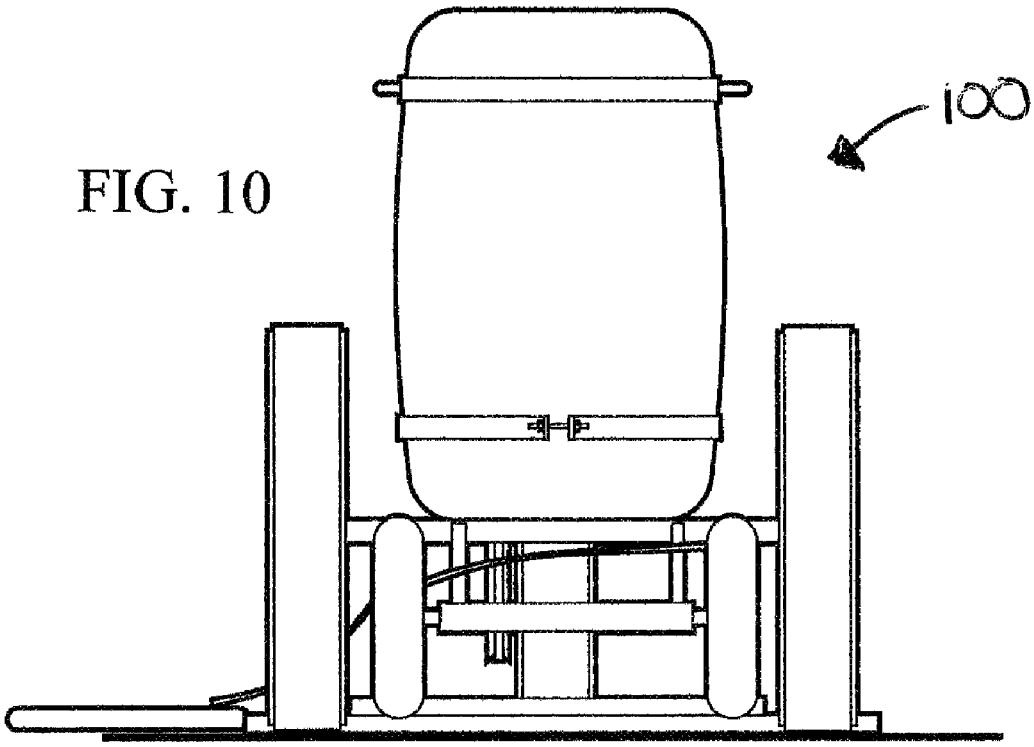
FIG. 10 is a front elevational view of the present invention, a riding floor and edge stripper applicator.
Figure 15:
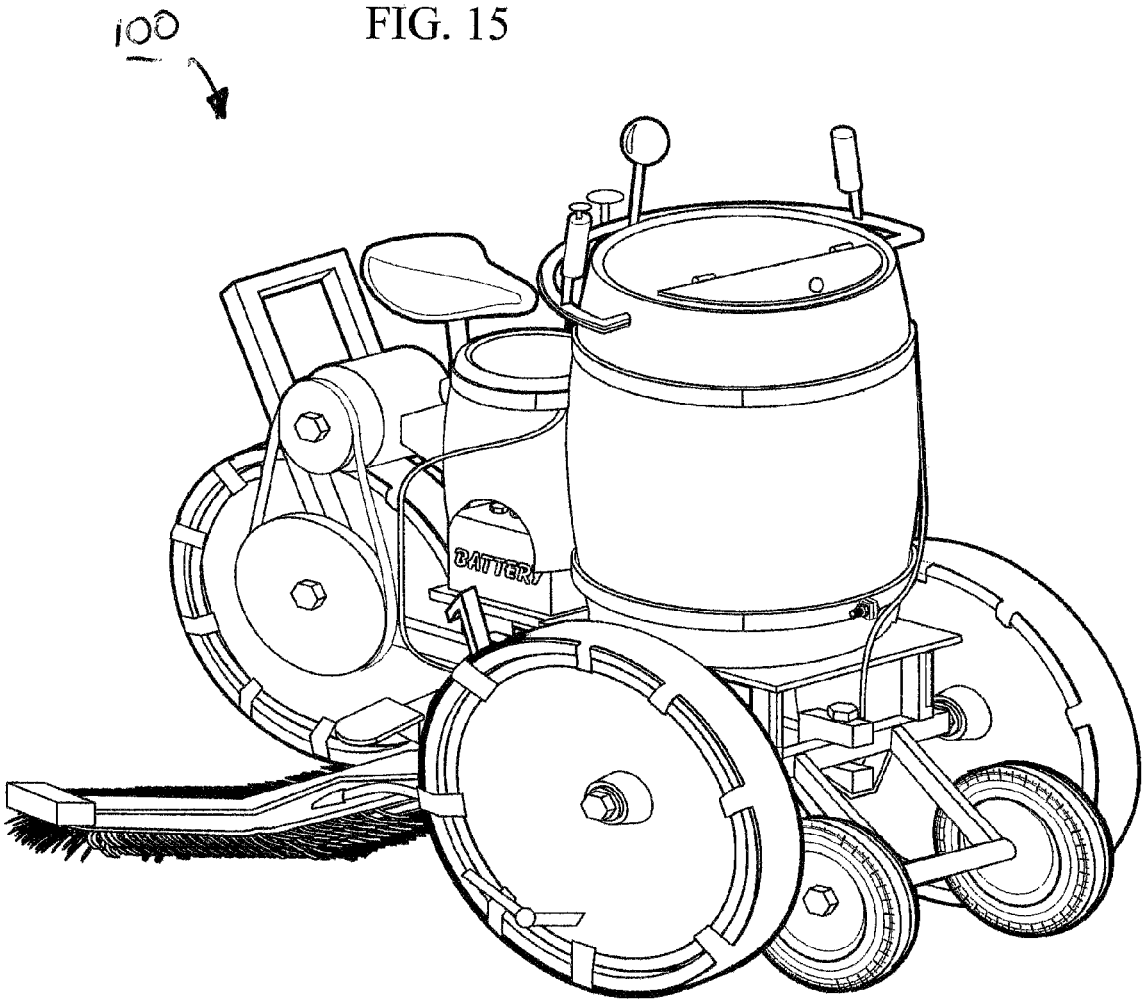
FIG. 15 is a front side perspective view of the present invention a riding floor and edge stripper applicator.

The present riding floor and edge stripper applicator shown generally as 100 is a riding floor and edge stripper applicator which includes the following components namely, forward frame 110, boom 112, connecting forward frame 110 with rear frame 116 at pivot 114. In this example the steering is accomplished by pivoting the forward frame 110 relative to the rear frame 116. Other steering mechanisms are possible including a steer able drive wheel 120 for example or driving front wheels 128 a differential speeds. The riding floor and edge stripper applicator 100 is not limited to the drive mechanism shown.

Seat 118, drive wheel 120, drive pulley 122, drive motor 142 and power pack 144 are all connected to rear frame 116. The figures show a motorized drive however the unit could also be powered by manual power such as a pedal drive system actuated by the users feet similar to a bicycle drive system. A manual drive may be a direct pedal drive without a chain directly to drive wheel 120 for example.

Central mop 130 is attached to forward frame 110 and swing mop 132 is attached to central mop 130 and includes an edge applicator 134 mounted on an edge end 251 of swinging mop 132. Edge applicator receives stripper fluid from supply conduits 160 and applies the fluid to the wall edge or baseboard when the edge applicator 134 makes contact with the vertical portion of the wall edge or baseboard.

Central mop 130 includes central mop frame 202, having a pivot cylinder 204 attached thereon and connected to swinging mop frame 206, such that swinging mop frame 206 pivots, at pivot point 208 with respect to central mop 202. Front wheels 128 as well as drive wheel 120 include tire covers 150 which are removable covers providing grip on slick surfaces, such as when stripper is applied to a floor.

Auxiliary wheels 140 are also attached to forward frame 110 and are used to transport the riding floor and edge stripper applicator 100 from one job site to another, thereby avoiding contact of front wheels 128 with dirty surfaces when moving from one job site to another.

Riding floor and edge stripper applicator 100 includes a main tank 136 which normally would house a stripping solution as well as secondary tank 138 which includes a special stripping solution which is supplied to edge applicator 134. Solutions from main tank 136 and secondary tank 138 are delivered to central mop 130, swinging mop 132 and edge applicator 134 via supply conduits 160 which communicates stripping fluids to the desired location.

Riding floor and edge stripper applicator 100 also includes a steering handle 170 which houses thereon operator controls 180 for controlling fluid flow to the central mop 130, the swinging mop 132, the edge applicator 134 as well as for pivoting the forward frame 110 for turning riding floor and edge stripper applicator 100 left and right.

Swing mop control pedals 126 are provided in order to activate pivot cylinder 204 in order to either extend swinging mop 132 or retracting swinging mop 132. Further controls are provided for engaging and disengaging drive wheel 120 and providing for forward and reverse movement of riding floor and edge stripper applicator 100.

Referring now to FIGS. 6, 7 and 8 showing central mop 130 pivotally connected to oblong swinging mop 132, wherein in FIG. 6 it shows the swinging mop portion in the fully retracted position in dashed line in the partially extended in solid lines and in FIG. 7 it shows swinging mop 132 in the fully extended position in solid lines and in a hyper extended position in dashed lines in FIG. 7, such that in the extended position the central mop and the swinging mop aligned substantially lengthways and in the retracted position the swinging mop lengthways direction oriented perpendicularly to the central mop lengthways direction, wherein the swinging mop pivoting in a plane parallel to the floor.

Referring now to FIG. 8, swing mop 132 includes a flexible tip portion 161 which has a certain amount of resilience or flexibility which allows it to flex and/or pivot independently of swinging mop 132. Flexible tip portion 161 is normally resiliently biased in unfolded position 165 and moveable to folded position 163 when the tip strikes a rigid object. Flexible tip 161 is shown in the unfolded position 165 in solid lines and in a folded position 163 in dashed lines, and folds when for example flexible tip 163 makes contact with a floor edge vertical surface such as a base board.

A person skilled in the art can see by using various controls on the riding floor and edge stripper applicator, one is able to extend swinging mop 132 from the fully retracted position 281 shown in dashed lines in FIG. 6 to a hyper extended position 283 shown in dashed lines in FIG. 7 or to a partially extended position 285 as shown in solid lines in FIG. 6. In FIG. 7 swinging mop 132 is shown in an extended position 287. In this way, one can maneuver swinging mop 132 around various obstacles by either extending or retracting swing mop portion 132, relative to central mop 130. In addition, when flexible tip 161 encounters the edge of a floor such as a base board, for example flexible tip 161 will flex as shown in FIG. 8 in dashed lines to a folded position 163, thereby maintaining good contact with a floor edge vertical surface such as a baseboard (not shown).

Referring now to FIGS. 11, 12, 13 and 14 which shows more details of front wheels 128 showing tire covers 150 thereon. Note also that drive wheel 120 in similar fashion also has a tire cover 150 thereon. Therefore FIGS. 11 through 14 inclusively depict not only front wheels 128, but also drive wheel 120 in regard to the cover components shown in these diagrams.

Tire covers 150 include attachment points 153 which are fastened together using a tightening cord 151 for holding tire cover 150 around the out diameter of tread 155 of wheel rim 157. Tire cover 150 is made of an abrasive material which is able to penetrate through the floor stripper and/or for that matter any emulsified floor finish and be able to gain traction onto the floor being stripped, even though there is a combination of floor stripper and emulsified floor finish lying wet on the floor. In this manner, riding floor and edge stripper applicator 100 will be able to gain traction and move comfortably without sliding over a wet floor surface having a floor stripper applied to it and/or having floor stripper as well as emulsified floor finish laying on the floor.

Preferably tire covers 150 are removable as depicted in FIGS. 11 through 14, however, it may be possible to manufacture front wheels 128 and drive wheel 20 with an abrasive material impregnated into the tire tread 155, wherein there is not a removable tire cover 150. The abrasive material used for the tire covers 150 or to be incorporated directly into the tire tread can for example be a waterproof abrasive such as scrubbing pads or an abrasive as applied to waterproof sand papers.

Preferably tire cover 150 is removable, such that when the tire covers 150 become contaminated with dirt and/or wear out, they can be easily replaced by detaching tightening cords 151 from attachment points 153, thereby allowing tire cover 150 to be removed.

Stripper as used herein means domestic and industrial floor strippers applied to floor surfaces and used to chemically remove existing floor finishes.

What is claimed is:

1. A riding floor and edge stripper applicator comprising:

a) a frame including attached thereto at least three wheels, a seat and a drive and steering mechanism for driving and steering the wheels;

b) at least one tank mounted on the frame for holding stripping solution in fluid communication with supply conduits for delivering stripping solution;

c) a central located oblong mop for receiving striping solution from the supply conduits and applying the solution to the floor;

d) at least one oblong swinging mop "oriented in offset relationship to the central mop,"—projecting from the central mop—for receiving striping solution from the supply conduits and applying the solution to a floor, the swinging mop pivotally attached at a pivot point at one distal end to the central located oblong mop and selectively moveable between an extended position and a retracted position, such that in the extended position the central mop and the swinging mop aligned substantially lengthways and in the retracted position the swinging mop lengthways direction oriented perpendicularly to the central mop lengthways direction, e) wherein the swinging mop pivoting in a plane parallel to the floor.

2. The riding floor and edge stripper applicator claimed in claim 1, wherein the swinging mop further including a flexible tip portion attached at one distal end of the swinging mop and dimensioned to make contact with a floor edge vertical surface, wherein the tip, portion normally resiliently biased in an unfolded position and moveable to an folded position when the tip strikes a rigid object.

3. The riding floor and edge stripper applicator claimed in claim 2, wherein the swinging mop including an edge applicator mounted to said flexible tip at an edge end of the swinging mop for applying stripper fluid to the floor edge vertical surface.

4. The riding floor and edge stripper applicator claimed in claim 1, wherein the wheels including tire covers made of an abrasive material which provides traction on wet surfaces on which stripper has been applied.

5. The riding floor and edge stripper applicator claimed in claim 1, wherein the wheels including a tread including an impregnated abrasive material for providing traction on surfaces.

6. The riding floor and edge stripper applicator claimed in claim 1, wherein the tire covers including tightening cords attached at attachment points around the wheel rim for releasably attaching the tire cover to a wheel.

7. The riding floor and edge stripper applicator claimed in claim 1, wherein the frame including a forward frame connected at a pivot to a rear frame such that the forward frame can be pivoted relative the rear frame about the pivot.

8. The riding floor and edge stripper applicator claimed in claim 1, further including a secondary tank for holding a second stripping fluid, including further supply conduits for communicating the fluid to the mops.

9. The riding floor and edge stripper applicator claimed in claim 1, further including auxiliary wheels for rollably moving the riding floor and edge stripper applicator from one job location to the next without contamination of the main wheels.

10. The riding floor and edge stripper applicator claimed in claim 1, wherein the drive mechanism including a manual crank operated with foot pedals and a chain drive to one of the wheels.

11. The riding floor and edge stripper applicator claimed in claim 1, wherein the drive mechanism including an electric motor operably connected to one of the wheels for driving the riding floor and edge stripper applicator.

12. The riding floor and edge stripper applicator claimed in claim 11, wherein the electric motor connected by belts to a wheel for operably driving the riding floor and edge stripper applicator.

* * * * *